US007963629B2

(12) United States Patent
Sasagawa

(10) Patent No.: US 7,963,629 B2
(45) Date of Patent: Jun. 21, 2011

(54) EJECTION STATUS DETERMINING METHOD FOR INKJET PRINTING HEAD

(75) Inventor: Naoto Sasagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 12/638,272

(22) Filed: Dec. 15, 2009

(65) Prior Publication Data

US 2010/0156982 A1 Jun. 24, 2010

(30) Foreign Application Priority Data

Dec. 18, 2008 (JP) ..... 2008-322583

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 4,550,327 | A | 10/1985 | Miyakawa | 346/140 R |
| 5,530,462 | A | 6/1996 | Takahashi et al. | 347/23 |
| 6,074,034 | A | 6/2000 | Maeda | 347/17 |
| 6,168,261 | B1 | 1/2001 | Miyake et al. | 347/40 |
| 6,174,039 | B1 | 1/2001 | Miyake et al. | 347/12 |
| 6,598,952 | B2 * | 7/2003 | Ishinaga et al. | 347/14 |
| 2007/0291069 | A1 * | 12/2007 | Shihoh et al. | 347/19 |

FOREIGN PATENT DOCUMENTS

| | | |
|---|---|---|
| JP | 58-118267 | 7/1983 |
| JP | 02-194967 | 8/1990 |
| JP | 02-289354 | 11/1990 |
| JP | 03-234636 | 10/1991 |
| JP | 06-079956 | 3/1994 |

* cited by examiner

*Primary Examiner* — Julian D Huffman
(74) *Attorney, Agent, or Firm* — Fitzpatrick, Cella, Harper & Scinto

(57) ABSTRACT

The present invention is to provide, for each nozzle, a temperature sensor that detects a temperature change accompanying driving an ejection heater. In the temperature change, an inflection point appears when an ink is ejected normally. Then, calculated is a summation of absolute values of the differences between a value of second derivative in each point of temperature data in a predetermined section including the timing at which this inflection point appears and a first threshold value based on the second derivative when an ejection-failure occurrence. Since the second derivative when the ejection-failure has occurred does not vary virtually, the summation becomes to be approximately zero. Therefore, appears clearly the difference with the time of normal ejection. From the magnitude relation between the summation and a second threshold value predetermined with respect to the summation, it can be determined whether the normal ejection is being carried out for every nozzle.

5 Claims, 16 Drawing Sheets

EJECTION STATUS DETERMINING METHOD FOR INKJET PRINTING HEAD

BACKGROUND OF THE INVENTION

1. Field of the Invention

The present invention relates to an ejection status determining method determining an ink ejection status of an inkjet printing head having a heating element (heater) generating thermal energy as energy utilized for ejecting the ink from a nozzle.

2. Description of the Related Art

Among the inkjet printing methods which eject ink for example, in a droplet form, from an ejection opening, and apply it to paper, plastic film, and other printing media, there exists one using a printing head having a heater generating thermal energy as energy utilized for ejecting the ink. This method has such advantages as that a high-resolution printing can be realized, and that a high density mounting of nozzles is facilitated, because an electro-thermal transducer element generating heat in response to a supplied current, its drive circuit and the like can be formed using a process like a semiconductor manufacturing process, for example.

On the other hand, also in the printing head according to this method, an ejection-failure may occur in all of or a part of the nozzles of the printing head, due to such causes as clogging of the nozzle caused by a foreign matter, thickened ink or the like, a bubble mixed in an ink supply path or the nozzle, or variations of wettability of the nozzle forming face of the printing head. In order to avoid deterioration of image quality caused in the case of such ejection-failure occurrence, it is preferred to carry out promptly a recovery operation recovering the ejection status and a complement operation by using other nozzles. However, in order to carry out these operations promptly, it has been an extremely important subject to carry out accurately and timely determination of the ejection status or determination of the ejection-failure occurrence.

Then, conventionally, various ejection status determination methods and complementing methods, or apparatuses to which these are applied have been proposed.

In Japanese Patent Laid-Open No. H6-79956 (1994), as a print method acquiring an image without image defects by detecting a printed matter, disclosed is a configuration which prints a predetermined pattern on the paper for the detection, and reads it by a reader to detect an abnormal print element. According to Japanese Patent Laid-Open No. H6-79956 (1994), an image without image defects can be acquired by moving image data to be applied to the abnormal print element, superimposing it on image data of other print element and complementing the printing thereof.

In Japanese Patent Laid-Open No. H3-234636 (1991), disclosed is a configuration provided with detecting means (reading head) for detecting whether an ink has been ejected or not in order to equalize ejection operations of nozzles disposed in a printing-medium width direction in a configuration using heads (line head) corresponding to the printing-medium width. Then, in Japanese Patent Laid-Open No. H3-234636 (1991), disclosed is also a configuration setting up a suitable control based on a driving condition of the nozzle at the time of the detection.

Furthermore, in Japanese Patent Laid-Open No. H2-194967 (1990), as a method detecting ink droplet flying, disclosed is a configuration determining an ejection status of the ink droplet at each ejection opening by detecting means having a pair of a light emitting device and a light receiving element disposed at one end and the other end of an ejection opening array of the printing head, respectively.

In Japanese Patent Laid-Open No. S58-118267 (1983), disclosed is a configuration which, without detecting an ejection status directly, utilizes a conductor part disposed in a position influenced by heat generated with a heater, and detects a change of a resistance of the conductor part varying depending on the temperature, that is, a method of carrying out detection in an ink source side is disclosed.

Furthermore in Japanese Patent Laid-Open No. H2-289354 (1990), disclosed is a configuration provided with heaters and a temperature detecting element on the same support member (heater board), such as a Si substrate, as the configuration in which detection is carried out in an ink ejection source side. In this Japanese Patent Laid-Open No. H2-289354 (1990), it is described that the temperature detecting element formed in a film shape is provided so that it overlaps with the arraying area of the heaters. In this Japanese Patent Laid-Open No. H2-289354 (1990), it is described that non-ejection is determined from a change in a resistance of the temperature detecting element in response to the temperature change. Furthermore, it is also described that a film-shaped temperature detecting element is formed on the heater board by means of a film-forming process, and is connected, via a terminal, with the outside by using such a method as a wire bonding.

However, in the ejection status determination method disclosed in Japanese Patent Laid-Open No. H6-79956 (1994), a nozzle in an ejection-failure status is detected from the result acquired by reading a check pattern printed on a sheet of paper. Accordingly, printing of the check pattern before the determination is a prerequisite, and it is extremely difficult to carry out the ejection status determination promptly. It is necessary to provide a reader, thereby increasing size and cost of the printing apparatus.

Also in the configurations disclosed in Japanese Patent Laid-Open Nos. H3-234636 (1991) and H2-194967 (1990), it is difficult to reduce size and cost of the apparatus, and is also difficult to detect promptly the nozzle having an ejection-failure.

Furthermore, in the configurations disclosed in Japanese Patent Laid-Open Nos. S58-118267 (1983) and H2-289354 (1990), the problems associated with Japanese Patent Laid-Open Nos. H6-79956 (1994), H3-234636 (1991) and H2-194967 (1990) are considered to be mitigated. However, in view of determining the ejection status accurately, it is still insufficient, and especially, in Japanese Patent Laid-Open No. H2-289354 (1990), a nozzle in an ejection-failure status cannot be specified exactly, either.

SUMMARY OF THE INVENTION

An object of the present invention is to solve the above-mentioned problems and to make it possible to carry out determination of an ejection status of each nozzle or to carry out determination of ejection-failure occurrence exactly and timely while suppressing increase in size and cost of the apparatus without increasing the apparatus scale.

In a first aspect of the present invention, there is provided an ejection status determining method determining an ink ejection status of a inkjet printing head including a heating element generating thermal energy as the energy utilized for ejecting ink and a temperature detecting element detecting a temperature change accompanying driving the heating element, the method comprising the steps of: extracting, as extracted data, temperature information at a plurality of points in a predetermined section including a timing at which appears a inflection point arising from the ink being ejected normally by the driving of the heating element, in a descending process of the temperature detected by the temperature detecting element after the driving of the heating element; computing a summation of absolute values of differences between each of curvatures of the temperature change curve at the plurality of points and a first threshold value determined based on a curvature of a temperature change curve in the case of an ejection-failure occurring; and determining an ejection status of the ink, based on the computed summation and a second threshold value with respect to the summation determined in advance.

In a second aspect of the present invention, there is provided an ejection status determining method determining an ink ejection status of a inkjet printing head including a heating element generating thermal energy as the energy utilized for ejecting ink from a nozzle and a temperature detecting element detecting a temperature change accompanying driving the heating element, the method comprising the steps of: extracting, as extracted data, temperature information at a plurality of points in a predetermined section including a timing at which appears a inflection point arising from the ink being ejected normally by the driving of the heating element, in a descending process of the temperature detected by the temperature detecting element after the driving of the heating element; acquiring a second derivative by performing second order differentiation on the extracted data with respect to time; computing a summation of absolute values of differences between each of values of the second derivative at the plurality of points and a first threshold value determined based on the second derivative in the case of an ejection-failure having occurred; and determining an ejection status of the ink, based on the computed summation and a second threshold value with respect to the summation determined in advance.

In a third aspect of the present invention, there is provided an ejection status determining method determining an ink ejection status of a inkjet printing head including a heating element generating thermal energy as the energy utilized for ejecting ink from a nozzle and a temperature detecting element detecting a temperature change accompanying driving the heating element, the method comprising the steps of: extracting, as extracted data, temperature information at a plurality of points in a predetermined section including a timing at which appears a inflection point arising from the ink being ejected normally by the driving of the heating element, in a descending process of the temperature detected by the temperature detecting element after the driving of the heating element; acquiring a second derivative by performing second order differentiation on the extracted data with respect to time; comparing each of values of the second derivative at the plurality of points with a first threshold value determined based on the second derivative in the case of an ejection-failure having occurred; computing a summation of absolute values of differences between each of the values determined to be smaller than the first threshold value in the comparison step and the first threshold value; and determining an ejection status of the ink, based on the computed summation and a second threshold value with respect to the summation determined in advance.

In a fourth aspect of the present invention, there is provided an ejection status determining method determining an ink ejection status of a inkjet printing head including a heating element generating thermal energy as the energy utilized for ejecting ink from a nozzle and a temperature detecting element detecting a temperature change accompanying driving the heating element, the method comprising the steps of: extracting, as extracted data, temperature information at a plurality of points in a predetermined section including a timing at which appears a inflection point arising from the ink being ejected normally by the driving of the heating element, in a descending process of the temperature detected by the temperature detecting element after the driving of the heating element; acquiring a second derivative by performing second order differentiation on the extracted data with respect to time; comparing each of values of the second derivative at the plurality of points with a first threshold value determined based on the second derivative in the case of an ejection-failure having occurred; preparing updated data where the value determined to be smaller than the first threshold value in the comparison step is updated by subtracting the first threshold value therefrom; acquiring sum data obtained by summing the updated data with respect to a plurality of the nozzles; computing a summation of the sum data with respect to the plurality of points; and determining, based on the computed summation and the summation of the updated data for one nozzle ejecting the ink normally, whether or not there exists a nozzle with the ejection-failure having occurred among the plurality of nozzles.

In a temperature change at the time of driving a heating element, an inflection point appears when an ink is ejected normally. Then, the present invention calculates a summation of absolute values of the differences between a curvature or a value of second derivative in each point of temperature data in the above-mentioned predetermined section and a first threshold value based on the curvature or the second derivative at the time of the ejection-failure occurrence. Since the curvature or the second derivative at the time of the ejection-failure occurrence is not varied virtually, the summation at the time of the ejection-failure occurrence becomes to be a value close to zero. Therefore, there appears clearly the difference with the case of normal ejection where the curvature or the second derivative changes greatly before and after the inflection point. Then, from the magnitude relation between the above-mentioned summation and a second threshold value determined in advance with respect to the summation, it can be determined whether the normal ejection is carried out or the ejection-failure has occurred.

With the arrangement, it will become possible to carry out the determination of the ejection status of each nozzle or to carry out the determination of the ejection-failure occurrence exactly and timely while suppressing increase in size and cost of the device without increasing the apparatus scale.

Especially in a fourth aspect of the present invention, by summing values to be smaller than the first threshold value with respect to the second derivative of the temperature data in the predetermined section of a plurality of nozzles, it is determined whether there exists a nozzle with the ejection-failure having occurred among the selected plurality of nozzles. Then, only when it is determined that there exists the nozzle with the ejection-failure, the ejection status determination can be carried out anew by selecting nozzles one by one. According to this, it is possible to realize high-speed determination processing.

Further features of the present invention will become apparent from the following description of exemplary embodiments (with reference to the attached drawings).

DESCRIPTION OF THE EMBODIMENTS

Hereinafter, with reference to drawings, the present invention is described in detail.

1. First Embodiment

Configuration of Printing Apparatus

First, described is a configuration of an inkjet printing apparatus applicable in common to some embodiments described in the following.

Figure 1:
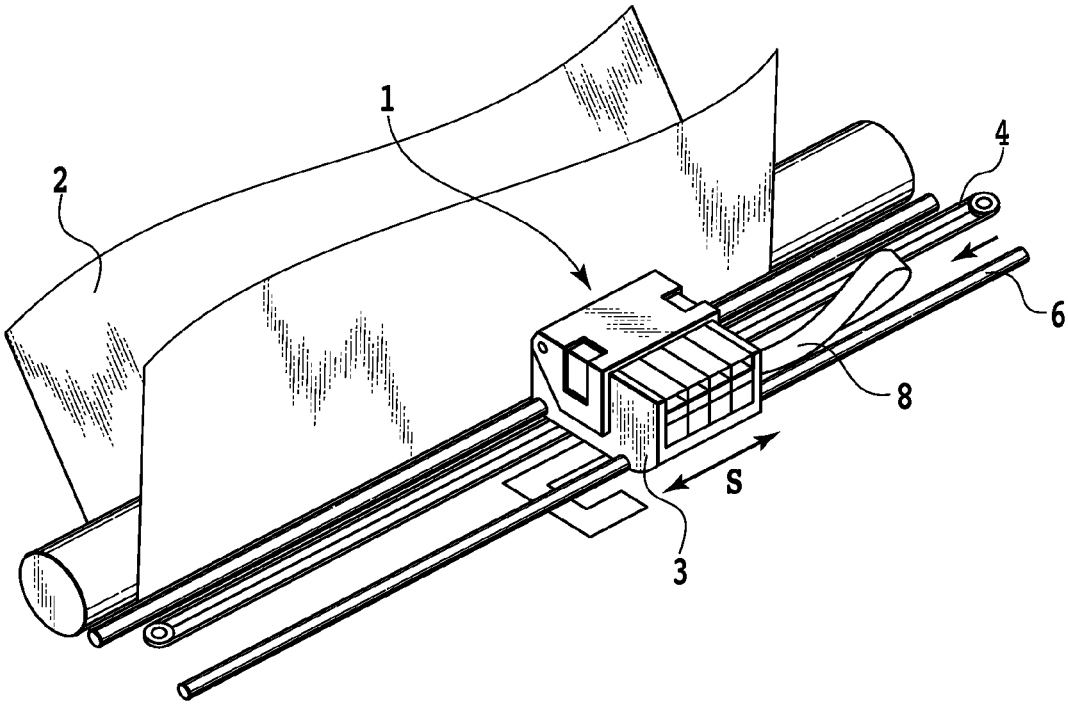
FIG. 1 is a schematic perspective view showing a serial inkjet printer as a printing apparatus to which the present invention can be applied.

FIG. 1 illustrates a serial-type inkjet printer as a printing apparatus to which the present invention can be applied. A printing head 1 is mounted on a carriage 3, and the carriage 3 is supported and guided by a guide rail 6 so as to allow reciprocation movement along it in a direction indicated by an arrow S in accordance with rotation of a timing belt 4. The printing head 1 has a nozzle group disposed on a surface opposing a printing medium 2 in a different direction from the moving direction of the carriage 3. Then, in a process in which the carriage 2 and the printing head 1 move in the direction of the arrow S, printing on the printing medium 2 is carried out by ejecting ink according to printing data from the nozzle group of the printing head 1.

A plurality of the printing head 1 may be provided in consideration of ejecting a plurality of colors of ink, and it is possible to print by using, for example, the inks having a color of cyan (C), magenta (M), yellow (Y), and black (Bk). The printing head 1 may be provided, separably or inseparably, integrally with ink tanks each storing the ink. Alternatively, the printing head may be one to which the ink is supplied via a tube etc. from the ink tank provided in a fixed portion of the apparatus. The carriage 3 is provided with, via a flexible cable 8 and a connector, an electric connection part for transmitting a driving signal etc. to each printing head 1.

Although not illustrated in FIG. 1, a recovery unit may be provided which is used for maintaining or recovering an ink ejection operation of the printing head or the nozzle in a good condition within a moving range of the printing head and outside a printing area for the printing medium 2. As the recovery unit, one having a well-known configuration can be adopted. For example, it is possible to adopt one provided with a cap for capping a nozzle forming face of the printing head, or with a pump for forcibly discharging the ink from the nozzle inside the cap by applying a negative pressure in the capping state. Further, it may be one which causes ejection (preliminary ejection) of the ink which does not contribute to printing of an image to be carried out inside the cap, for example.

(Configuration of Printing Head)

Figure 2A:
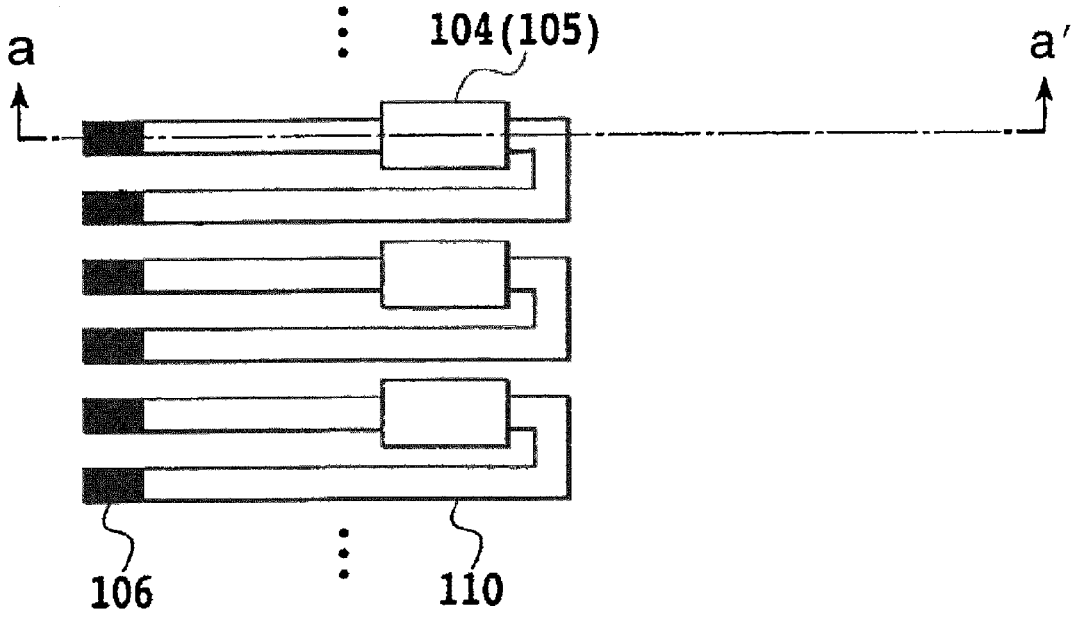
FIG. 2A is a schematic plan view illustrating a part of a substrate (heater board) according to an embodiment of an inkjet printing head having a temperature detecting element, and a schematic sectional view along a-a' line, respectively.
Figure 2B:
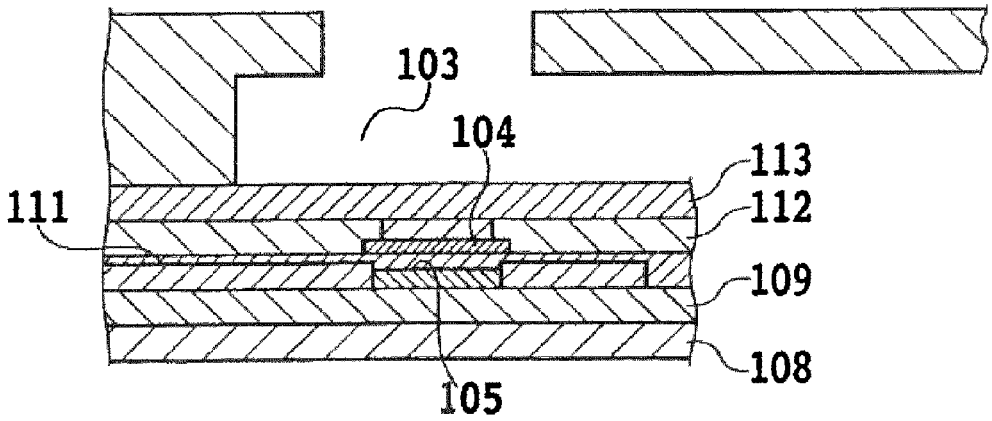
FIG. 2B is a schematic plan view illustrating apart of a substrate (heater board) according to an embodiment of an inkjet printing head having a temperature detecting element, and a schematic sectional view along a-a' line, respectively.

FIG. 2A and FIG. 2B are schematic plan views illustrating a part of a substrate (heater board) according to an embodiment of an inkjet printing head having a temperature detecting element, and a schematic sectional view along a-a' line thereof, respectively.

Electrical power (driving signal) is supplied for causing each of a plurality of nozzles 103 provided in an array to eject the ink. In response to this, an electro-thermal transducer element 104 (hereinafter, referred as an ejection heater) is heated, and by causing the ink to produce film boiling, for example, an ink droplet is ejected.

Reference numeral 106 denotes a terminal for supplying electric power, and it is connected with the outside by wire bonding. Reference numeral 105 denotes a temperature detecting element (hereinafter, referred as a temperature sensor), and it is formed in the heater board by the same film-forming process as that of the ejection heater 104, etc.

As illustrated in FIG. 2B, on a Si substrate 108 forming the heater board, the temperature sensor 105 formed by a thin film resistor such as Al, Pt, Ti, Ta, Cr, W, AlCu or the like of which resistance changes depending on a temperature is disposed via a heat storage layer 109 constituted by a thermal oxide film $SiO_2$ or the like. In the Si substrate 108, formed are wirings 110 of Al or the like including individual wirings for the respective ejection heaters 104 and wirings for connecting the ejection heaters 104 and a control circuit for selectively supplying electric power thereto. Furthermore, the ejection heater 104, a passivation film 112 of SiN or the like and an anticavitation film 113 are laminated and disposed with high density via an interlayer insulation film 111 in the same process as a semiconductor manufacturing process. As the anticavitation film 113, Ta or the like can be used for enhancing the anticavitation performance on the ejection heater 104.

The temperature sensor 105 formed as the thin film resistor is disposed just below each ejection heater 104, separately and independently, by the same number as that of ejection heater 104. The temperature sensor 105 may be formed as a part of the individual wiring 110. According to this, because the heater board manufacture can be carried out in the present embodiment without altering the conventional structure largely, there exists a large advantage for the manufacturing.

Figure 3:
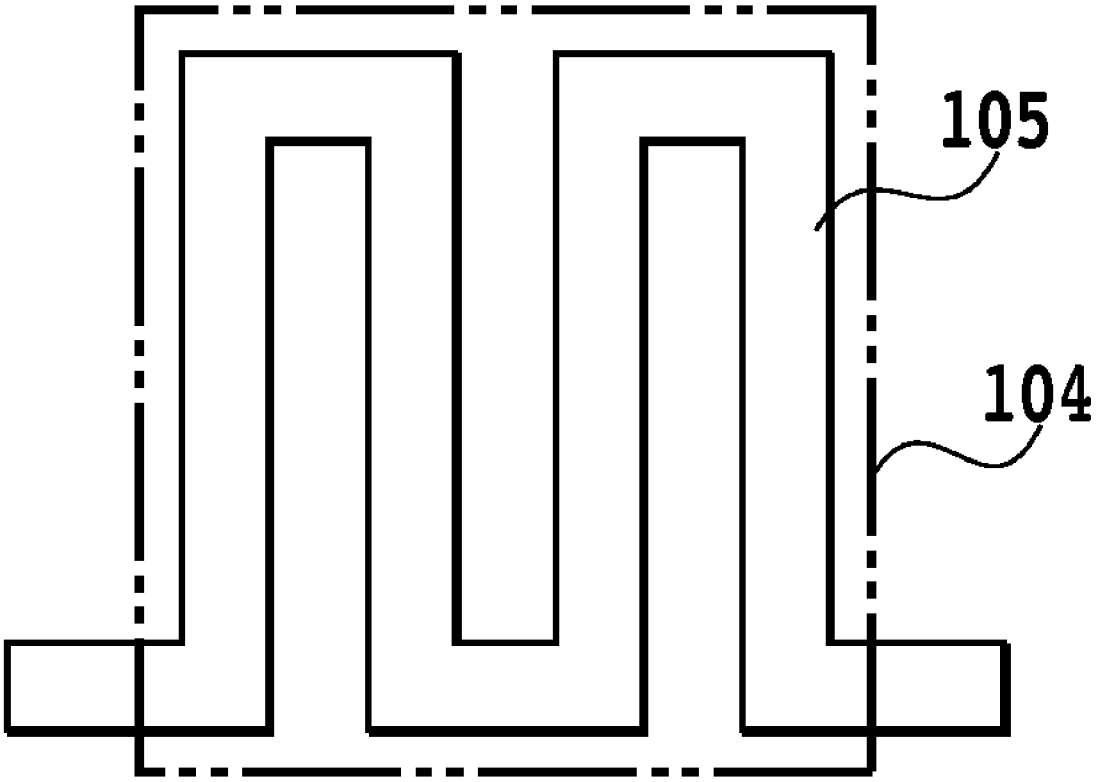
FIG. 3 is a schematic plan view showing an example of a temperature sensor having another shape which may be formed on the heater board shown in FIG. 2A.

A plane shape of the temperature sensor 105 can be determined suitably. As illustrated in FIG. 2A, it may have a rectangular shape having the similar dimension as that of the ejection heater 104, or may have a meandering shape as illustrated in FIG. 3. According to this, resistance-increasing of the temperature sensor 105 is attained, and it becomes possible to acquire a high detection value even in the case of a very small temperature change.

(Configuration of Control System)

Figure 4:
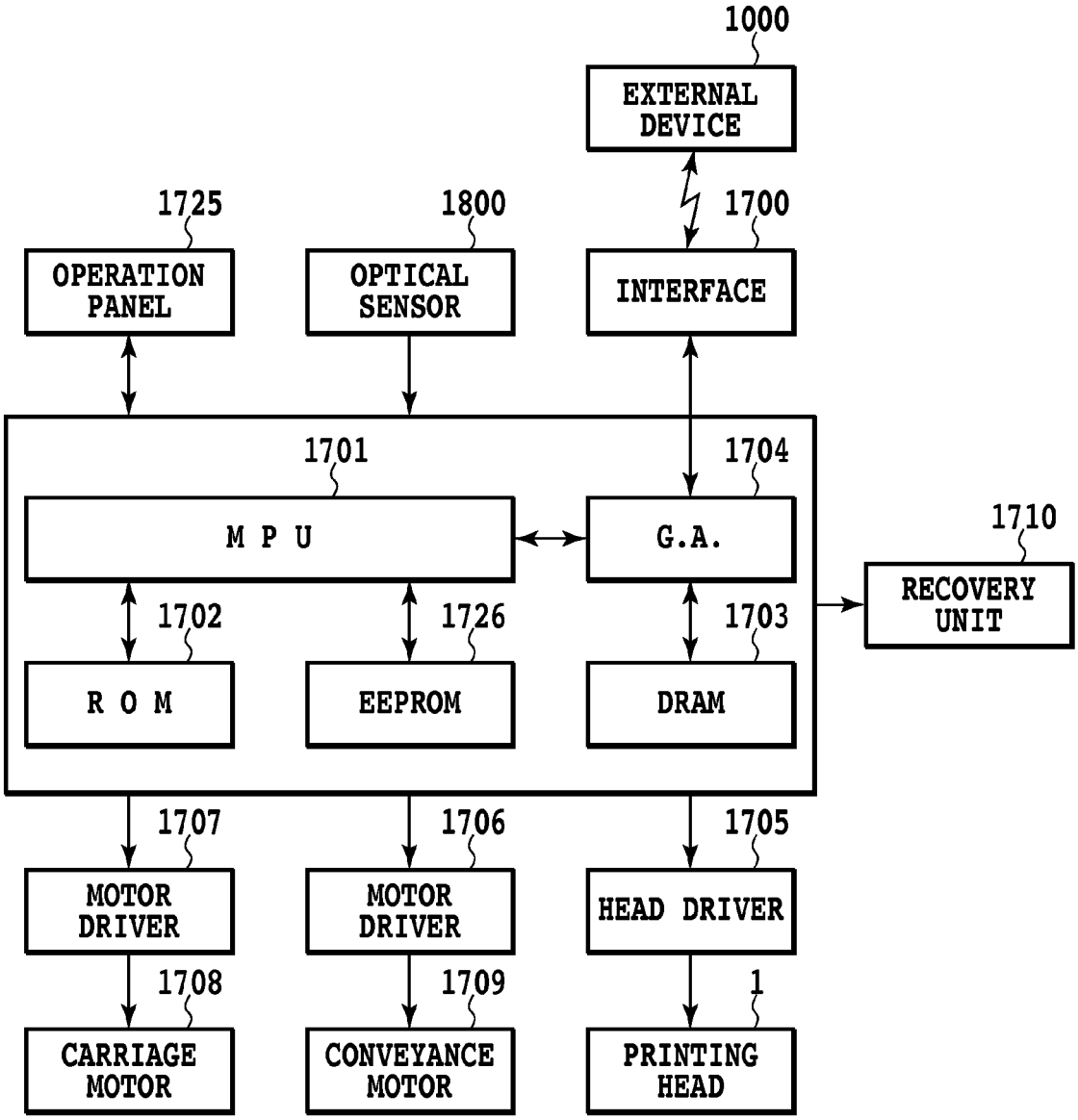
FIG. 4 is a block diagram illustrating an example of a configuration of a control system of a printing system including a printer having the configuration of FIG. 1.

FIG. 4 is a block diagram illustrating an example of a configuration of a control system of a printing system including a printer having the configuration of FIG. 1.

In FIG. 4, reference numeral 1700 denotes an interface, which receives a printing signal including a command and image data sent from an external device 1000 having a suitable configuration of a computer, etc. From the interface 1700 to the external device 1000, status information of a printer can be sent out if necessary. Reference numeral 1701 denotes an MPU, which controls each part in the printer in accordance with a control program or required data corresponding to a later-described processing procedure (for example ejection status determination) stored in a ROM 1702.

Reference numeral 1703 denotes a DRAM, which stores various data (the above-mentioned printing signal and the printing data supplied to the printing head, etc.). Reference numeral 1704 denotes a gate array (G. A.), which carries out supply control of the printing data for the printing head 1, and also carries out data transfer control among the interface 1700, the MPU 1701 and the DRAM 1703. Computation processings described later are carried out by at least one of the gate array (G. A.) 1704 and the MPU 1701.

Reference numeral 1726 denotes a nonvolatile memory such as an EEPROM for storing the data required also when the printer is powered off.

Reference numeral 1708 denotes a carriage motor, which is used for causing the carriage 3 to move reciprocally in the arrow direction as illustrated in FIG. 1. Reference numeral 1709 denotes a conveyance motor, which is used for conveying the printing medium 2. Reference numeral 1705 denotes a head driver which drives the printing head 1, and reference numerals 1706 and 1707 denote motor drivers for driving the conveyance motor 1709 and the carriage motor 1708, respectively. Reference numeral 1710 denotes a recovery unit, which may be one provided with the cap and pump, etc. as described above. Reference numeral 1725 denotes an operation panel, which has a setting input portion where an operator performs various settings for the printer and a display portion or the like displaying a message for the operator. Reference numeral 1800 denotes an optical sensor.

The printing head to which the present invention is applied, basically, has the ejection heater which is a heating element generating thermal energy as energy utilized for ejecting the ink, and has the temperature sensor which is a temperature detecting element detecting a temperature change accompanying driving of the ejection heater. First, in the first aspect of the present invention, extracted is, as extracted data, temperature information at a plurality of points in a predetermined section including a timing at which an inflection point arising from the ink being ejected normally appears in a descending process of the temperature detected by the temperature sensor after driving the ejection heater. Subsequently, computed is a summation of the absolute values of the differences between a curvature of the temperature change curve in each of the plurality of points of the extracted data and a first threshold value determined based on a curvature of a temperature change curve in the case of an ejection-failure occurring. Then, an ejection status of the ink is determined based on the computed summation and a second threshold value with respect to the summation determined in advance. Although this corresponds to the first aspect of the present invention, it is possible to reword "curvature" as "second derivative" from another viewpoint (the second aspect of the present invention).

Then, the third aspect of the present invention compares each of values of the second derivative at the plurality of points with the first threshold value, and calculates a summation of the absolute values of the differences between the values determined to be smaller than the first threshold value as the result of the comparison and the first threshold value, and therewith, determines an ink ejection status based on the second threshold value. The first embodiment corresponds to this third aspect of the present invention, and the principle thereof will be described in detail in the following.

Figure 5:
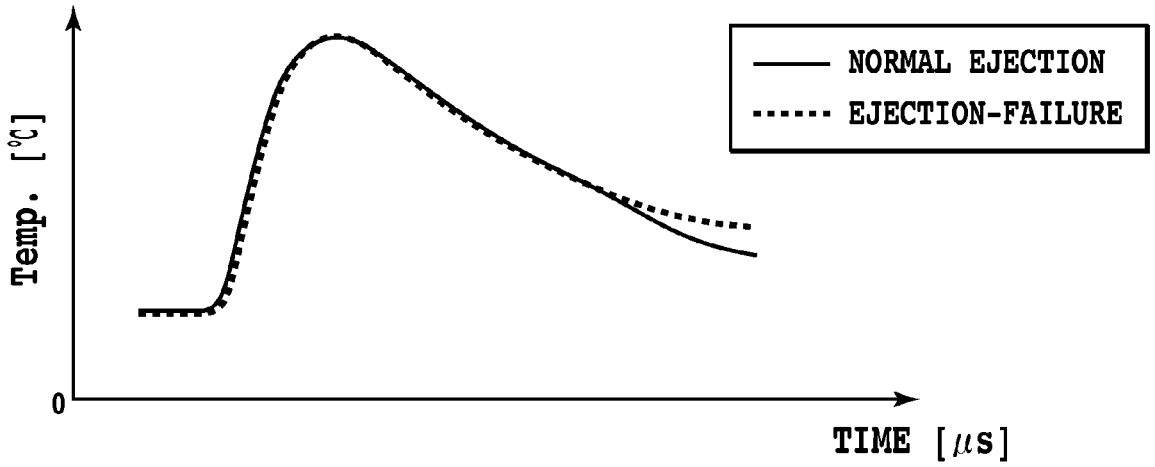
FIG. 5 is a diagram illustrating temperature changes detected by the temperature sensor 105 when ejection is carried out normally and when ejection-failure occurs.

FIG. 5 illustrates the temperature changes which the temperature sensor 105 detects when ejection is carried out normally and when ejection-failure occurs.

First, the temperature change (shown by a continuous line) when ejection is carried out normally will be described. When a pulsed voltage is impressed to the ejection heater 109, the temperature of the ejection heater 104 abruptly rises. Along with that, the temperature of a boundary face between the ink and the anticavitation film also rises. When the temperature of the boundary face between the ink and the anticavitation film reaches a foaming (boiling) temperature of the ink, a bubble will be arising and growing. At this time, by the bubble arising, a portion of the anticavitation film 113 positioned just above the ejection heater 104 will be in a state of not being in contact with the ink. Since a thermal conductivity of the bubble is about a digit smaller compared with the thermal conductivity of the ink, the heat does not transfer much to the ink side in the state where the bubble exists in just above the ejection heater 104.

When the impression of the voltage pulse is stopped, the temperature will descend after passing through the highest achieving temperature. Although the bubble gradually contracts as it loses the heat, a flow arises in the ink from the ejection opening side to the bubble and heater board side from the difference generated between the pressure in the bubble and the atmospheric pressure. As a result, before the bubble disappears completely, the ink at the central upper part of the bubble contacts the anticavitation film 113. By the ink with the high thermal conductivity having contacted the anticavitation film 113, the heat flows into the ink from the heater board, and the temperature sensor 105 located on the heater board side is cooled down quickly. Therefore, in the descending process of the temperature detected by the temperature sensor 105, an abrupt change of a cooling rate arises.

Then, the temperature change (shown by a dotted line) when there exists the ejection-failure will be described. If the nozzle is clogged with dust and dirt, or the ink in the vicinity of the nozzle is thickened, it may be unable to eject the ink. Even in this case, in the same way as in the time of normal ejection, the bubble will arise and grow when the temperature rises depending on the impression of the voltage pulse to the ejection heater 104, and if the temperature of the boundary face between the ink and the anticavitation film reaches a foaming temperature of the ink. However, because the nozzle or the ejection opening is blocked up, the bubble will grow up to an upstream side of an ink supplying direction because of a high flow resistance on an ejecting direction side. Since the bubble disappears with the passage of time, and the flow of the ink depending on ejection does not arise either, the phenomenon that the ink at the central upper part of the bubble only contacts the anticavitation film 13 does not occur. Therefore, the boundary face between the ink and the anticavitation film will contract gradually, and the abrupt change of the cooling rate does not arise in the descending process of the temperature detected by the temperature sensor 105. Therefore, the existence or nonexistence of the normal ejection can be determined from existence or nonexistence of the abrupt change of the cooling rate.

Figure 6:
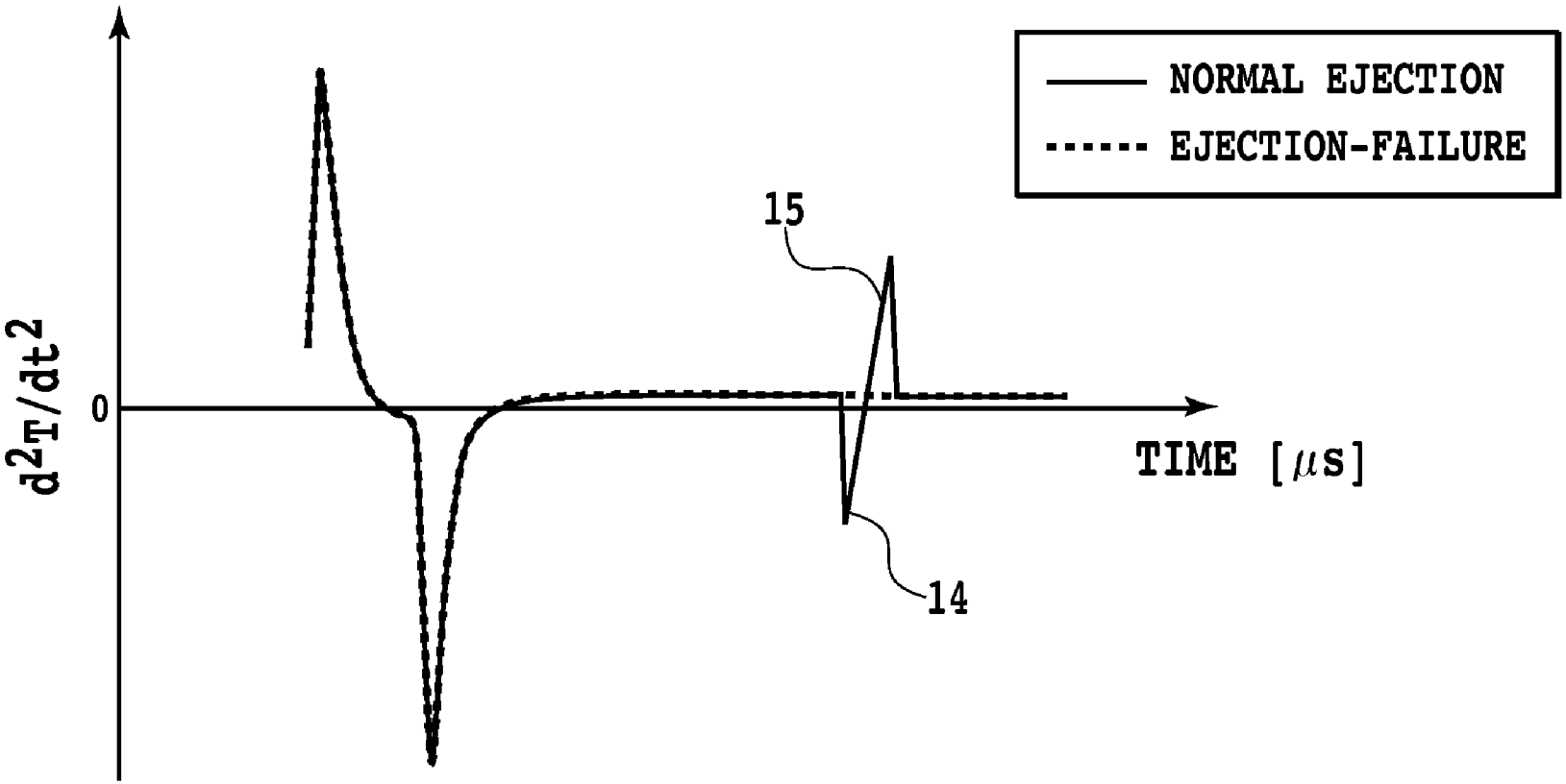
FIG. 6 is a diagram illustrating a result of carrying out the second order differentiation, with respect to time, of the temperature change of FIG. 5.

FIG. 6 illustrates a result of carrying out the second order differentiation, with respect to time, of the temperature change of FIG. 5.

When the ejection is carried out normally, a negative peak 14 and a positive peak 15 appear because there exists the abrupt change of the cooling rate in the descending process of the temperature. As compared with this, when the ejection-failure occurs, these peaks do not appear. Therefore, based on the result of carrying out the second order differentiation with respect to time, of the temperature change, for example, from whether the negative peak 14 exists or not, it will become possible to detect whether the abrupt change of the cooling rate has arisen or not, that is, whether the normal ejection has been carried out or not.

Figure 7:
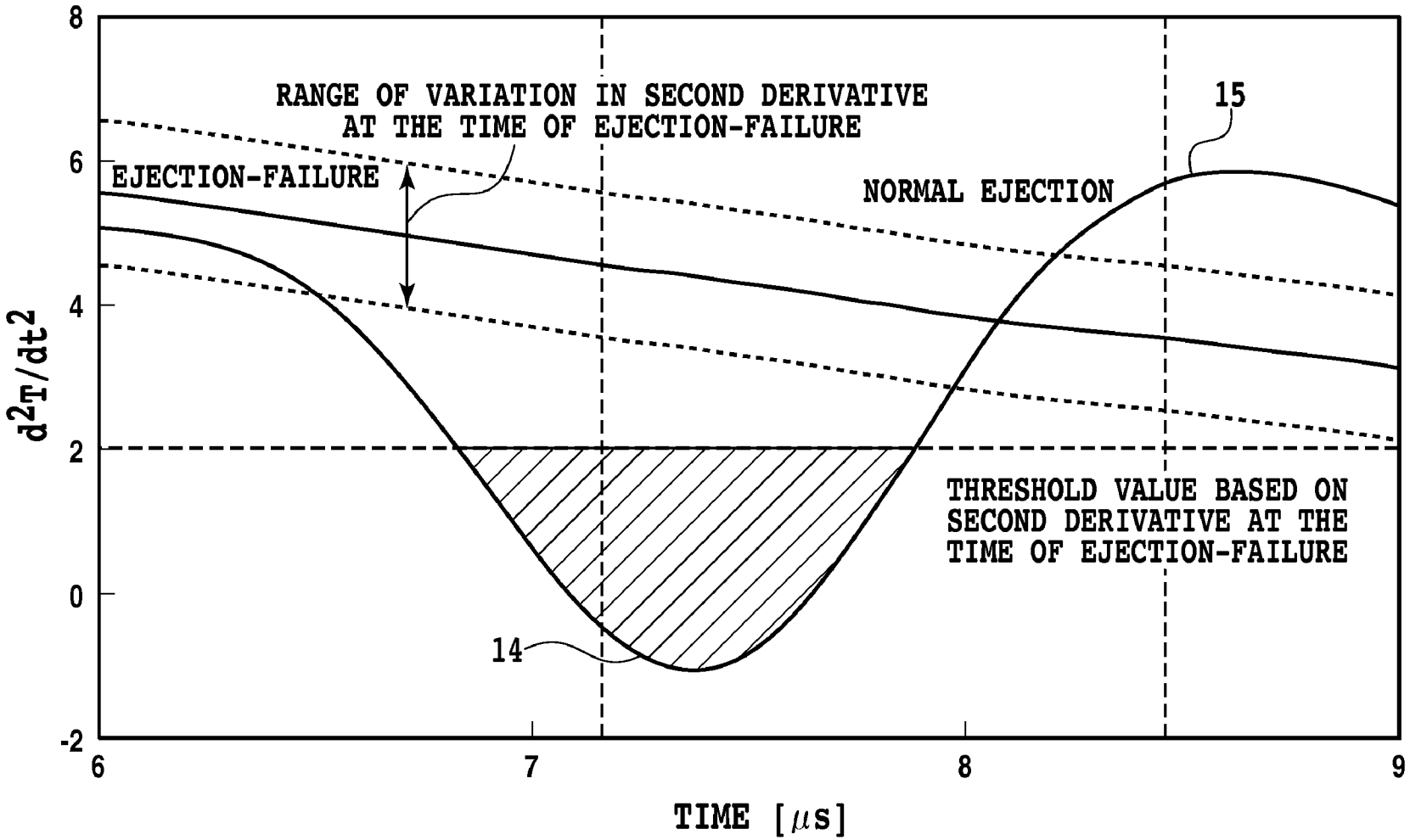
FIG. 7 is a diagram illustrating a relation, in the first embodiment of the present invention, between a threshold value determined based on the second derivative at the time of the ejection-failure occurrence and the second derivatives of the temperature changes detected by the temperature sensor at the time of the normal ejection and at the time of ejection-failure occurrence.

FIG. 7 is a figure illustrating a relation, in the first embodiment of the present invention, between the threshold value determined based on the second derivatives at the time of the ejection-failure occurrence and the second derivatives of the detected temperature change by the temperature sensor 105 at the time of the normal ejection and at the time of ejection-failure occurrence.

When the ejection has been carried out normally, the negative peak 14 appearing in the second derivative becomes a lower value than that of the second derivative at the time of the ejection-failure. Then, the positive peak becomes a higher value than that. Therefore, if the integration of the second derivative is carried out without using the threshold value based on the second derivative at the time of the ejection-failure, the negative peak 14 and the positive peak 15 have been cancelled mutually, and the difference at the time of normal ejection and the ejection-failure does not appear much. A temperature waveform detected by the temperature sensor 105 has a variation resulting from the difference in the heads or the nozzles. The present embodiment, taking into consideration the second derivative at the time of the ejection-failure as well as the variation thereof, sets the threshold value as the smaller value than the second derivative at the time of the ejection-failure, and calculates a summation of a portion not more than the threshold value.

The summation in the case of the ejection-failure becomes a value close to zero although it may have some value by being influenced by noise. On the other hand, at the time of the normal ejection, the influence of the positive peak 15 is removed and the negative peak 14 is computed as the summation. Therefore, when the ejection is carried out normally, the value of the summation becomes large as compared with the case of the ejection-failure. From these, it is possible to discriminate exactly the case of the ejection being carried out normally from the case of the ejection-failure.

Figure 8:
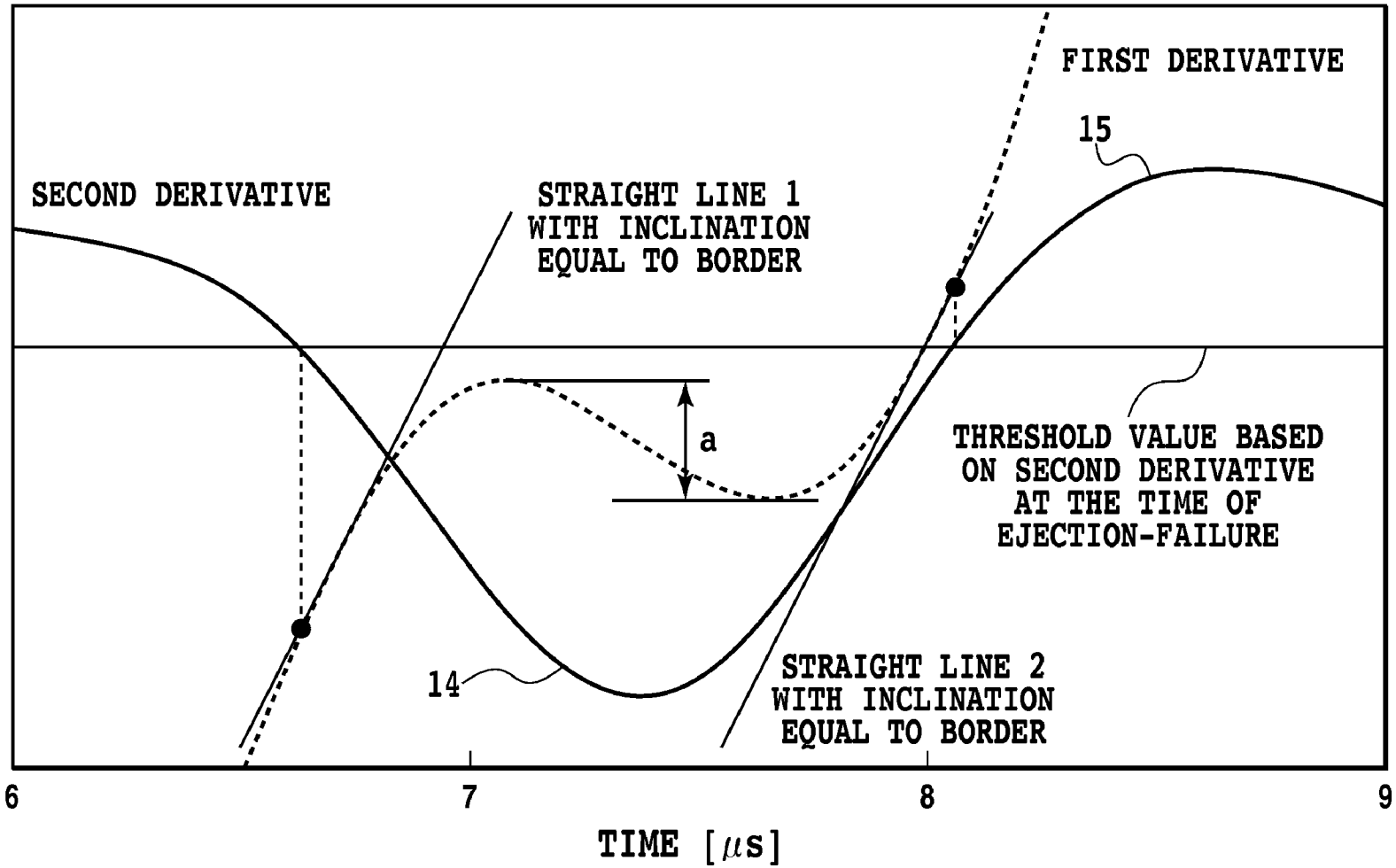
FIG. 8 is a diagram illustrating a relation, in the first embodiment of the present invention, between the threshold value based on the second derivative at the time of the ejection-failure occurrence and the first and the second derivatives at the time of the normal ejection.

FIG. 8 is a figure illustrating a relation, in the first embodiment of the present invention, between the threshold value based on the second derivative at the time of the ejection-failure occurrence and the first derivative and the second derivative at the time of the normal ejection.

In FIG. 8, an intersection point of the second derivative at the time of normal ejection and the threshold value based on the second derivative at the time of ejection-failure occurrence corresponds to a point of contact between the first derivative at the time of the normal ejection and a straight line (shown as "straight line 1 or 2 with an inclination being BORDER") of which an inclination is the threshold value based on the second derivative at the time of ejection-failure occurrence. Taking the summation of the absolute values of the differences between each values of the second derivative at a plurality of points when the ink has been ejected normally and the threshold value based on the second derivative at the time of ejection-failure occurrence is equal to taking the summation of the absolute values of the differences between the inclination at each point between the above-mentioned two points of contact and the threshold value based on the second derivative at the time of the ejection-failure occurrence. The value of the summation, where the threshold value based on the second derivative at the time of the ejection-failure occurrence is made to be zero, becomes to be the difference a between the positive and negative peaks of the first derivative at the time of the normal ejection. At the time of the ejection-failure occurrence, in many cases, it is not tangent to the straight line of which the inclination is the threshold value based on the second derivative at the time of the ejection-failure occurrence, and in that case, the summation becomes to be zero.

Figure 9:
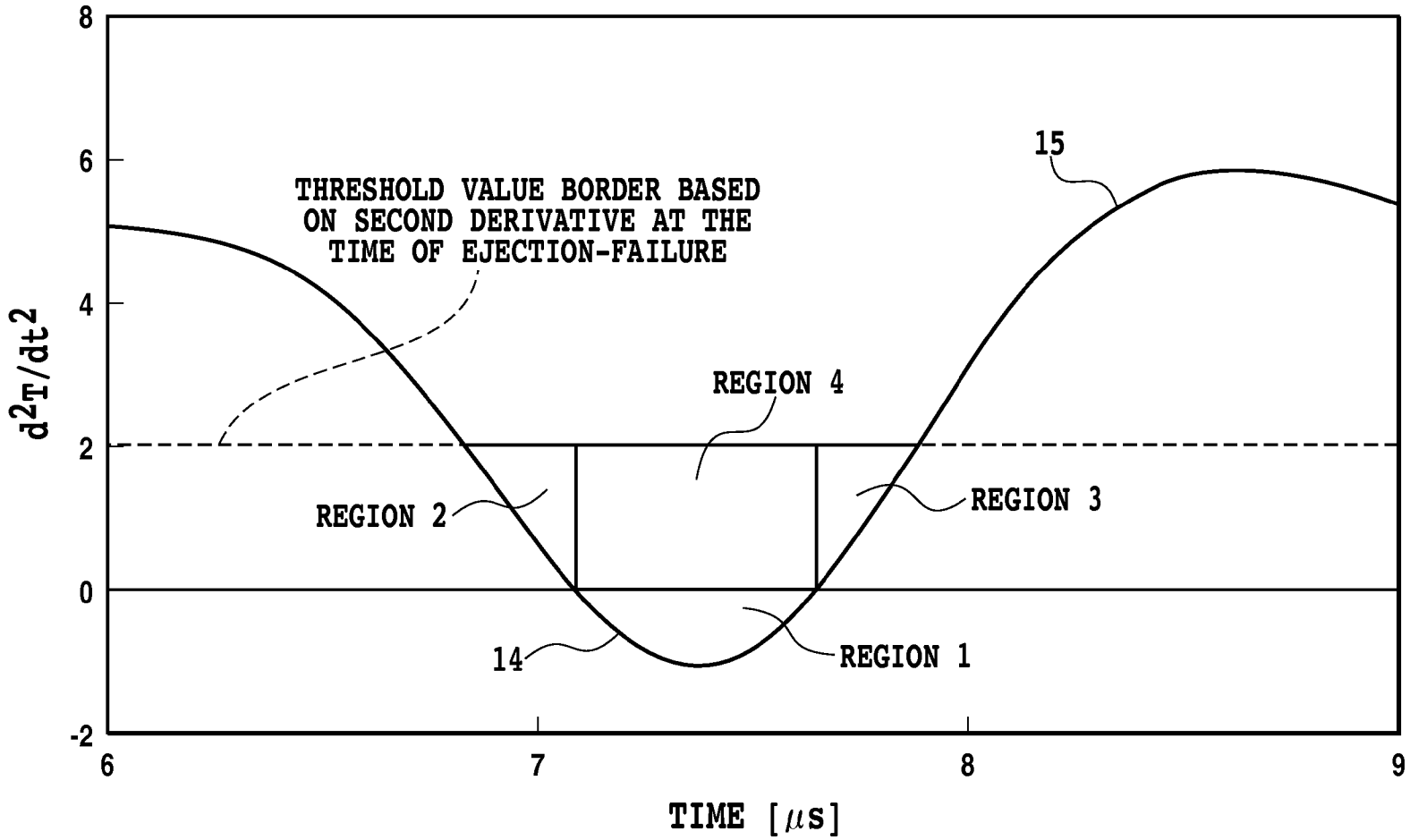
FIG. 9 is a diagram illustrating a relation, in the first embodiment of the present invention, between a summation and the threshold value based on the second derivative at the time of the ejection-failure occurrence.

FIG. 9 is a figure illustrating a relation between the threshold value based on the second derivative at the time of the ejection-failure occurrence and the summation in the first embodiment of the present invention.

At the time of normal ejection, the value of the summation, where the threshold value based on the second derivative at the time of the ejection-failure occurrence is made to be zero, becomes to be an area of "region 1".

Subsequently, the case, where the threshold value based on the second derivative at the time of the ejection-failure occurrence is larger than zero, will be investigated. By that the threshold value based on the second derivative at the time of the ejection-failure is added to the summation as offset (equivalent to "region 4"), and that the region to be added expands and becomes one including "region 2" and "region 3", the value of the summation will become larger than the value where the threshold value based on the second derivative at the time of the ejection-failure occurrence is made to be zero.

Figure 10:
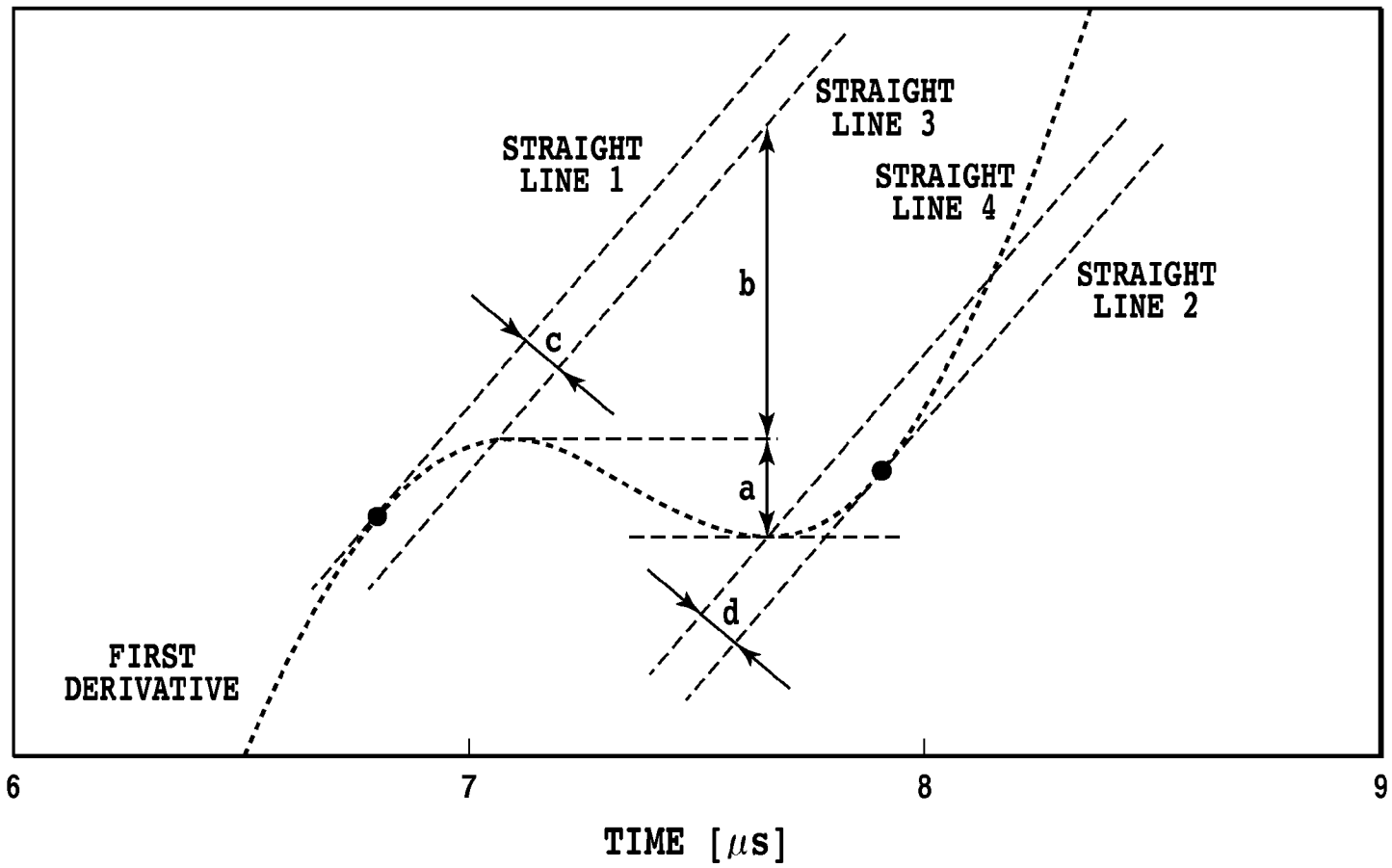
FIG. 10 is a diagram illustrating a relation, in the first embodiment of the present invention, between the threshold value based on the second derivative at the time of the ejection-failure occurrence, the first derivative at the time of the normal ejection and the summation.

FIG. 10 is a figure illustrating a relation, in the first embodiment of the present invention, among the threshold value based on the second derivative at the time of the ejection-failure occurrence; the first derivative at the time of the normal ejection; and the summation.

The inclination of each "straight line 1" to "straight line 4" is the threshold value based on the second derivative at the time of the ejection-failure occurrence. Among these, "straight line 1" and "straight line 2" are the straight lines tangent to the first derivative at the time of the normal ejection, and "straight line 3" and "straight line 4" are straight lines which pass through the local maximum point and local minimum point of the first derivative at the time of the normal ejection, respectively.

The summation of the absolute values of the differences between the inclination at each point from the point of contact of the first derivative at the time of normal ejection with "straight line 1" to the local maximum point of the first derivative and the threshold value based on the second derivative at the time of the ejection-failure occurrence, is equal to a distance between "straight line 1" and "straight line 3". This can be understood easily if FIG. 10 is rotated by the threshold value based on the second derivative. When "straight line 1" is considered to be the x axis, it is possible that the summation of the absolute values of the differences between the inclination in each point and the threshold value based on the second derivative at the time of the ejection-failure occurrence is a change of the y coordinate in this section. Similarly, the summation of the absolute values of the differences between the inclination in each point from the local minimum point to the point of contact of the first derivative at the time of normal ejection with "straight line 2" and the threshold value based on the second derivative at the time of the ejection-failure occurrence, is equal to the distance between "straight line 2" and "straight line 4".

The summation of the absolute values of the differences between the inclination in each point between the local maximum point and the local minimum point and the threshold value based on the second derivative at the time of the ejection-failure occurrence will become to be the following value. That is, it will become to be the value where the threshold value based on the second derivative at the time of the ejection-failure occurrence is added to the summation of the inclination at each point between the local maximum point and the local minimum point, where the number of the points is equal to the number of points between the maximum point and the minimum point. The summation of the inclination at each point between the local maximum point and the local minimum point is a. The value where the threshold value, at each point, based on the second derivative at the time of the ejection-failure occurrence is summed, where the number of the points is equal to the number of points between the local maximum point and the local minimum point, is a change b of the y coordinate when the x-coordinate changes from the local maximum point to the local minimum point in the straight lines of which the inclination is the threshold value based on the second derivative at the time of the ejection-failure occurrence.

Therefore, the summation becomes "a+b+c+d", and, from the above, it turns out that it becomes a value larger than the value a of the summation where the threshold value based on the second derivative at the time of the ejection-failure occurrence is made to be zero. The length a, b, c and d in FIG. 10 corresponds to the areas of "region 1", "region 4", "region 2", and "region 3" in FIG. 9, respectively.

Figure 11:
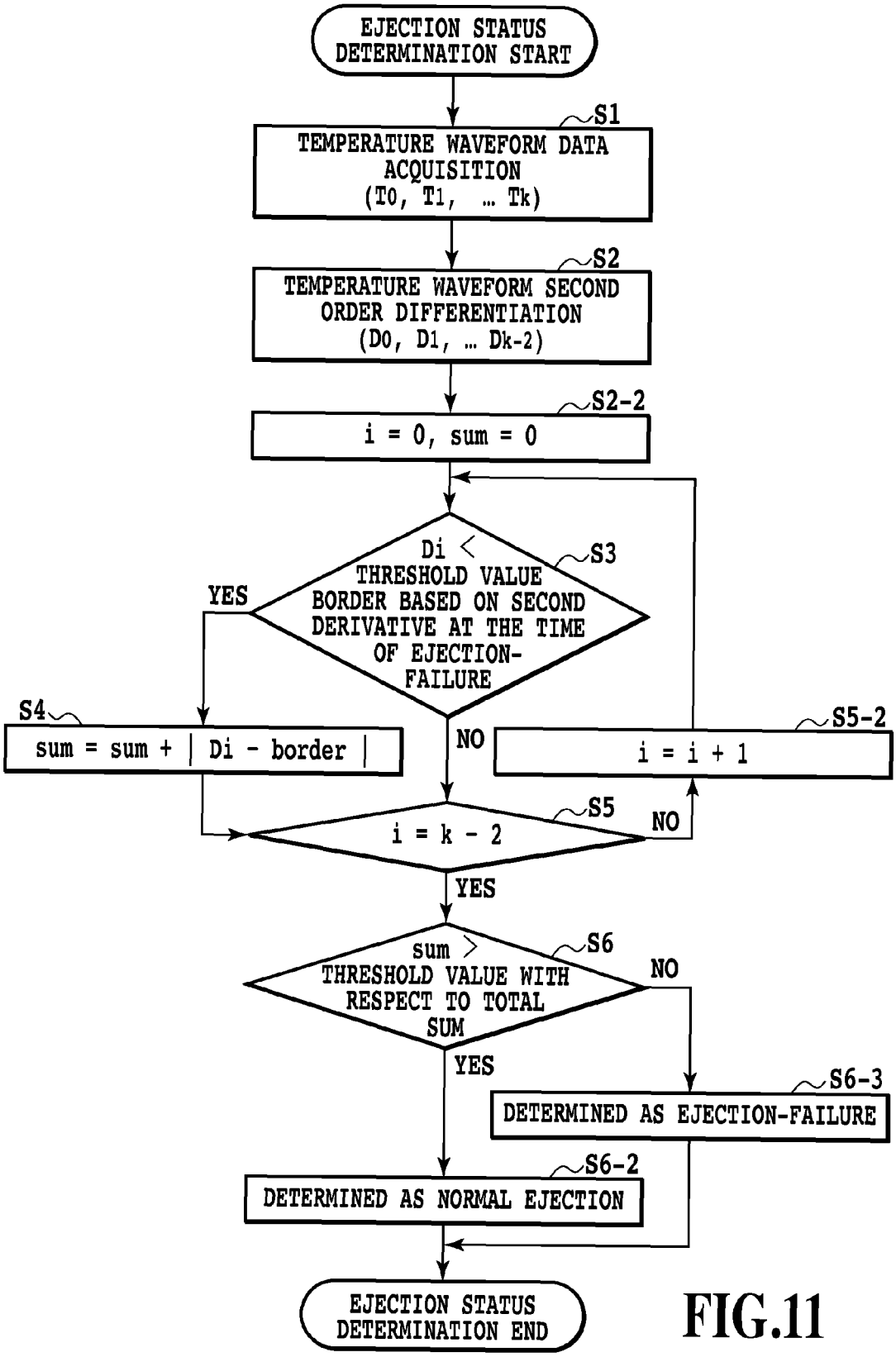
FIG. 11 is a flow chart illustrating the ejection status determining procedure in the first embodiment of the present invention.

FIG. 11 is a flow chart illustrating the ejection status determining procedure in the present embodiment.

In step S1, first, in the process in which the temperature descends, acquired are the temperature waveform data $T_0$, $T_1$, $T_2$ to $T_k$ at the k+1 points within the predetermined section including the timing at which appear the inflection points arising from the ink being ejected normally. The value of k can be determined suitably while a required accuracy or the like for the ejection status determination is taken into consideration.

Subsequently, in step S2, the second order differentiation of the temperature waveform data acquired at step S1 is carried out, and the second order differentiation waveform data $D_0$, $D_1$, $D_2$, to $D_{k-2}$ are acquired.

In step S2-2, each of a parameter i used in the following processing and a value "sum" used for the summation operation is reset to zero.

In step S3, the data Di, acquired at step S2, of the point in the second derivative is compared with the threshold value (first threshold value) based on the second derivative at the time of the ejection-failure occurrence. In the case of the former being smaller than the latter, the procedure will progress to step S4, while in the case of the former being not smaller than the latter, the procedure will progress to step S5.

In step S4, to "sum" added is the absolute value of the difference between the data Di, acquired at step S2, of the point in the second derivative and the threshold value based on the second derivative at the time of the ejection-failure occurrence.

In step S5, it is determined, based on the parameter i, whether the comparison of step S3 is completed or not with respect to the data of all the points in the second derivative. Then, if affirmative, the procedure will progress to step S6, while if negative, the parameter i is incremented by one in step S5-2, and the process will return to step S3.

In step S6, the value "sum" is compared with the threshold value (second threshold value) with respect to the summation. When the former is larger than the latter, it is determined that the normal ejection has been carried out (step S6-2), and when the former is not more than the latter, it is determined that the ejection-failure has occurred (step S6-3).

The processing of the ejection status determination described above can be carried out with respect to all the nozzles in suitable timing. For example, this can also be carried out during printing operation, and it is possible that this is allowed to be carried out on the occasion of the preliminary ejection. In any case, since the ejection status determination is one which is carried out according to the ejection operation of each nozzle, this can be carried out timely, and it becomes possible to specify exactly the nozzle which the ejection-failure has arisen. It becomes possible that the recovery process is carried out promptly depending on detection of the ejection-failure, or the operation which complements the printing with other nozzles is carried out promptly. Furthermore, determination of the most suitable driving pulse, a protection processing of the printing head from temperature rising etc., and warning to a user, etc. can be carried out promptly.

Figure 12:
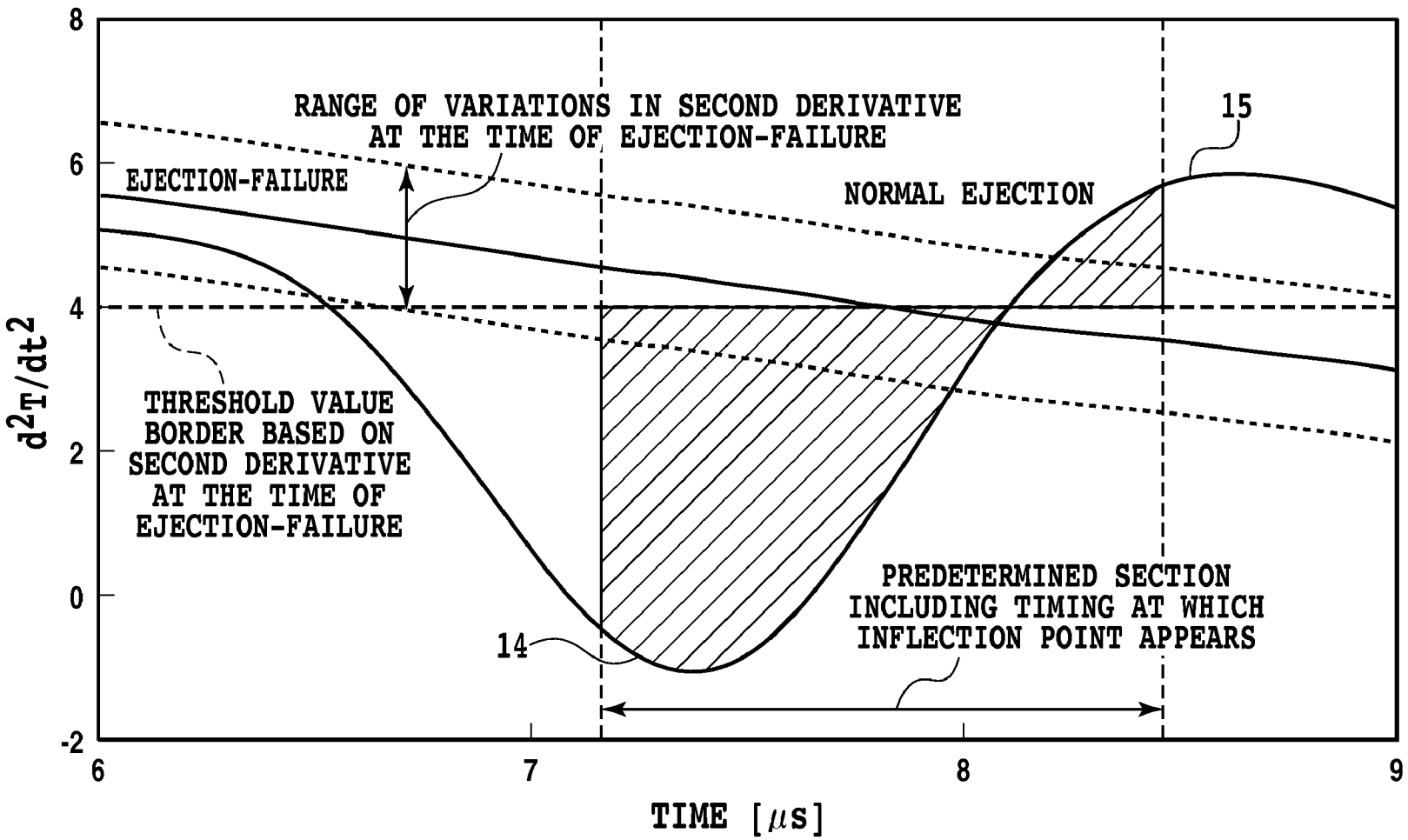
FIG. 12 is a diagram showing a relation, in a second embodiment of the present invention, between a threshold value determined suitably based on the second derivative at the time of the ejection-failure occurrence and the second derivatives of the temperature changes of the temperature detecting element at the time of normal ejection and at the time of ejection-failure occurrence.

FIG. 12 illustrates a relation, in a second embodiment of the present invention, between the threshold value determined suitably based on the second derivative at the time of the ejection-failure occurrence and the second derivatives of the temperature changes of the temperature detecting element at the time of normal ejection and at the time of ejection-failure occurrence.

In the present embodiment, used is the summation of the absolute values of the differences between the threshold value based on the second derivative at the time of the ejection-failure occurrence and each of the values of the second derivative. The threshold value based on the second derivative at the time of the ejection-failure occurrence is made to be set up in the vicinity of the center of variations in the second derivative at the time of the ejection-failure occurrence, and thereby, the value of the summation at the time of the ejection-failure occurrence is enabled to become small on the average. At the time of the normal ejection, owing to the appearance of the negative peak 14 and the positive peak 15, the value of the summation becomes larger than that at the time of the ejection-failure occurrence, and thereby, it is possible that the normal ejection and the ejection-failure occurrence are discriminated clearly.

Figure 13:
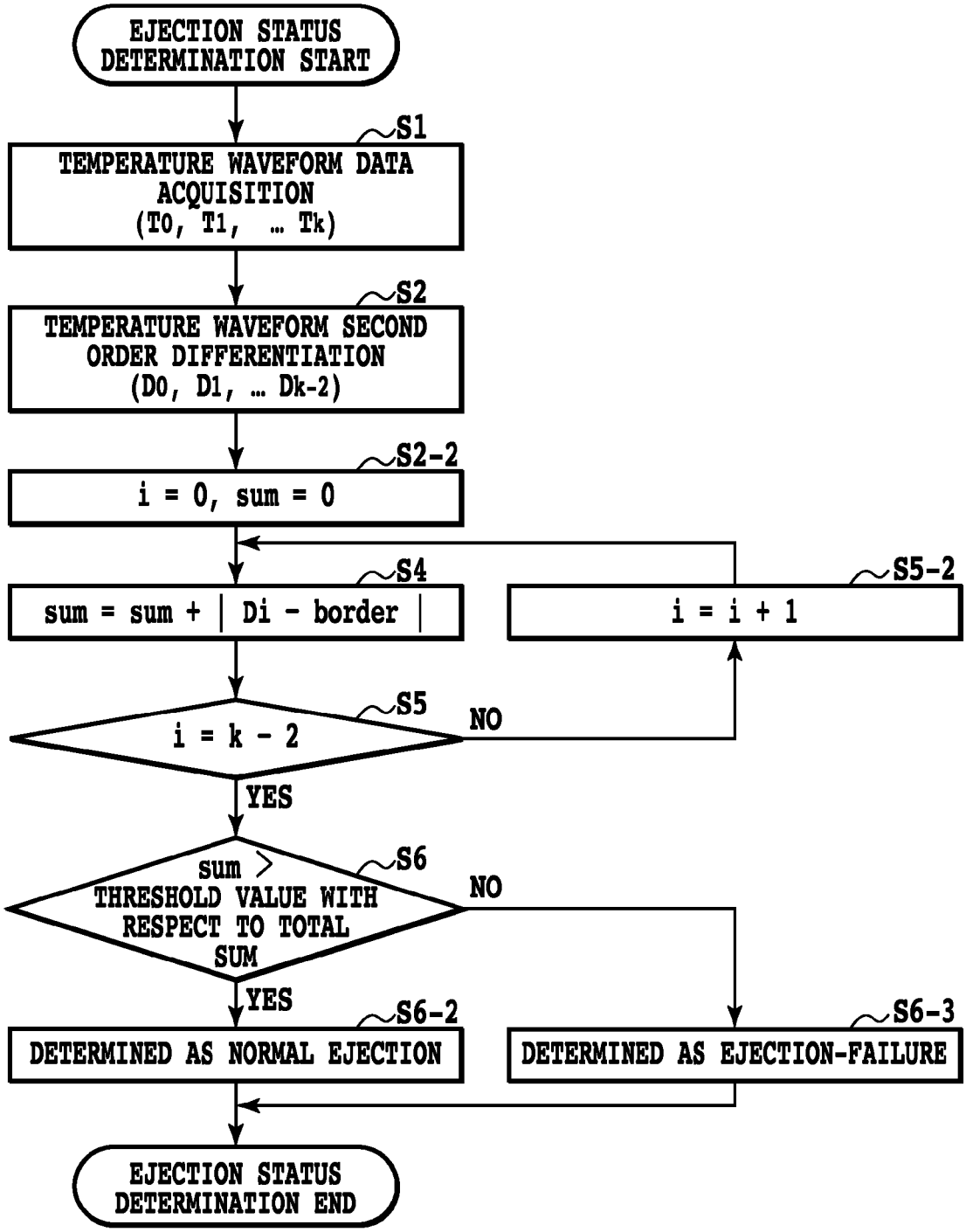
FIG. 13 is a flow chart illustrating the ejection status determining procedure in the second embodiment of the present invention.

FIG. 13 is a flow chart illustrating an ejection status determination processing procedure in the second embodiment of the present invention.

The present procedure differs from that of FIG. 11 in that excluded is step S3 for carrying out the comparison with respect to magnitude correlation between the threshold value based on the second derivative at the time of the ejection-failure occurrence and the value of second derivative. In other words, the present embodiment corresponds to the second aspect of the present invention, and has an advantage that a load of calculation is reduced rather than in the first embodiment.

3. Third Embodiment

A third embodiment described in the following corresponds to the fourth aspect of the present invention.

Figure 14:
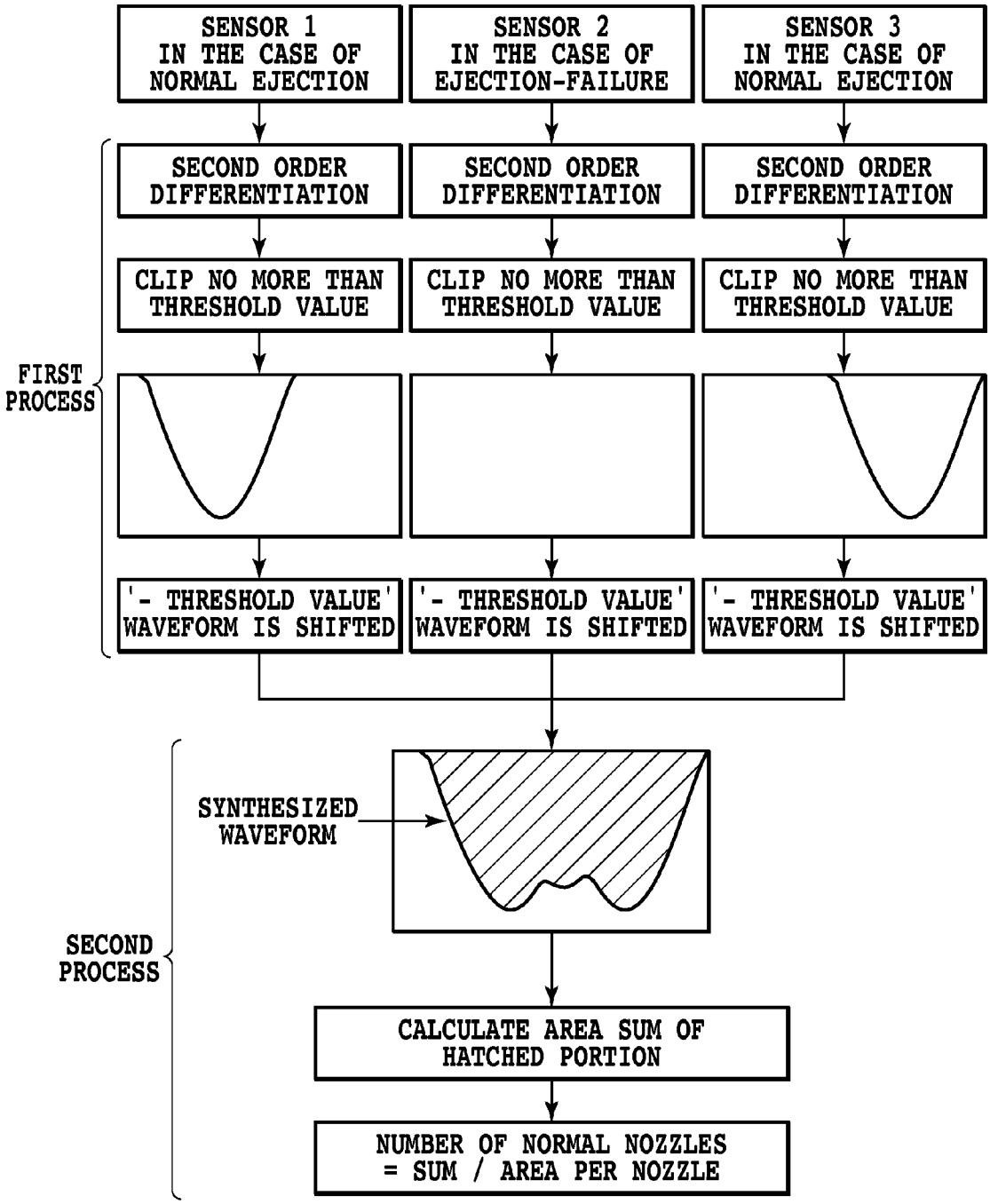
FIG. 14 is an explanatory diagram illustrating a summary of ejection status determination in a third embodiment of the present invention.

FIG. 14 is an explanatory diagram illustrating the summary of the ejection status determination in the third embodiment of the present invention.

In the present embodiment, the nozzle group disposed at the printing head is divided into N nozzles, and the processing is carried out. FIG. 14 is an explanatory diagram as N=3, and performed is the second order differentiation on the temperature waveform data based on detection of the temperature sensor 105 corresponding to each nozzle. Then, only the portions (shown as "– threshold value" waveform) not more than the threshold value based on the second derivative at the time of the ejection-failure occurrence are taken out (clipped), and are shifted suitably and synthesized. In FIG. 14, illustrated is a synthesized waveform of the second derivatives obtained by performing second order differentiation on the temperature waveform data detected by the temperature sensors 105 (SENSORs 1-3), in the case of the ejection-failure having occurred at one (to be detected by SENSOR 2) of three nozzles. Then, the area of the synthesized waveform is calculated, and the area is divided by an area in the case of one nozzle having ejected normally, and the quotient thereof is acquired. When this quotient is smaller than the number of the synthesizing waveform (three in FIG. 14), it is determined that there exists a nozzle with the ejection-failure. That is, in FIG. 14, first processes are carried out for the respective nozzles, and then a second process which synthesizes and processes the results of the first processes is carried out.

In the actual inkjet printing head, almost all nozzles carry out the ejection operation normally. In the present embodiment, a plurality of nozzles is determined in a lump. However, since almost all nozzles eject normally, as a determination result, it should be determined, with a considerably high probability, that the nozzle with the ejection-failure does not exist. Therefore, the existence or nonexistence of the ejection-failure occurrence is determined with the plurality of nozzles in a lump, and only in the case of the positive determination, the processing for specifying the nozzle with the ejection-failure may be carried out with respect to the nozzles in the lump or unit. Therefore, a high-speed determination can be carried out rather than determining the ejection status with respect to each of all the nozzles.

Figures 15, 15A:
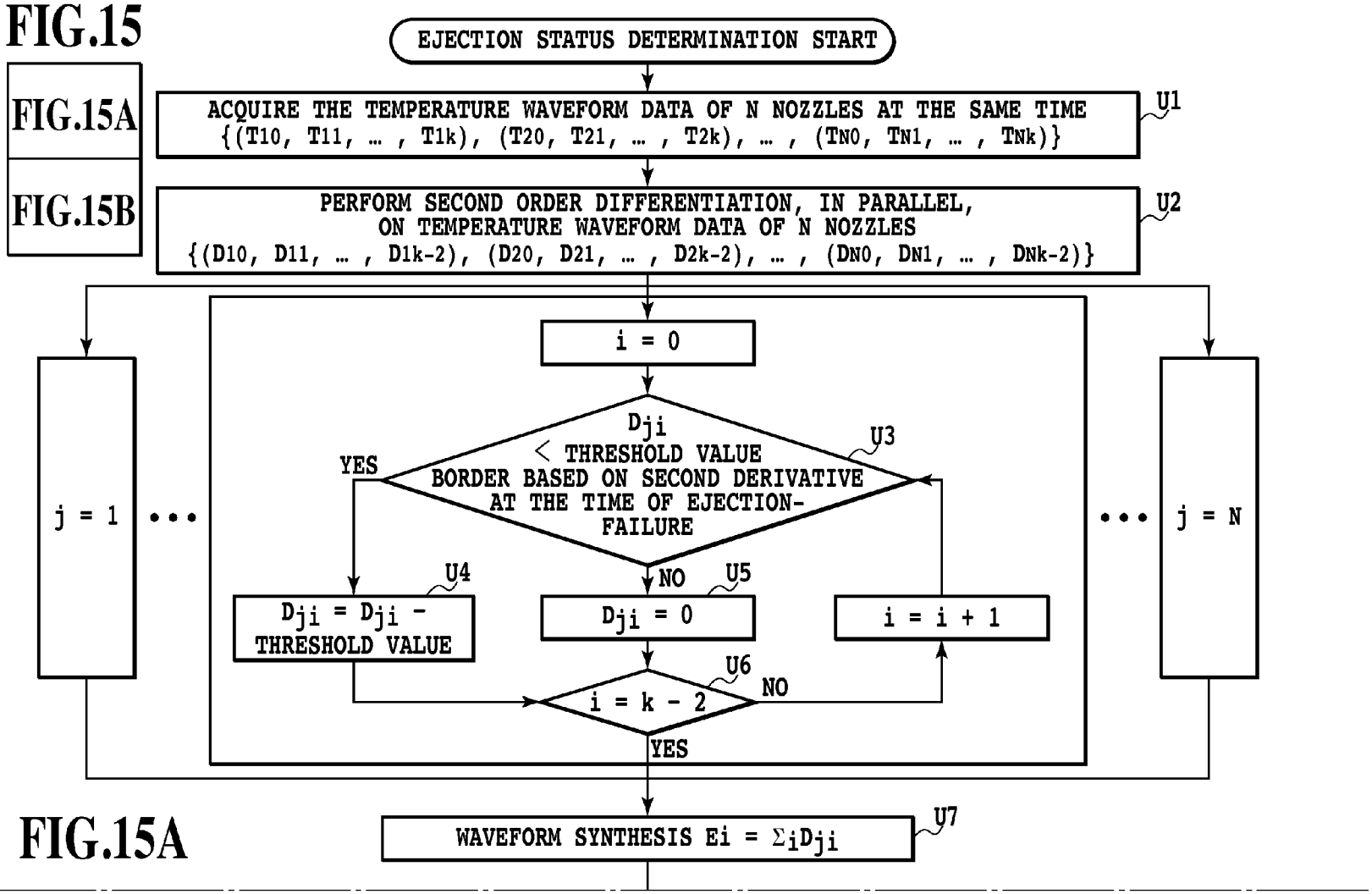
FIG. 15 is a diagram showing the relationship between FIGS. 15A, and 15B.
FIG. 15A is a flow chart illustrating the ejection status determining procedure in the third embodiment of the present invention.
Figure 15B:
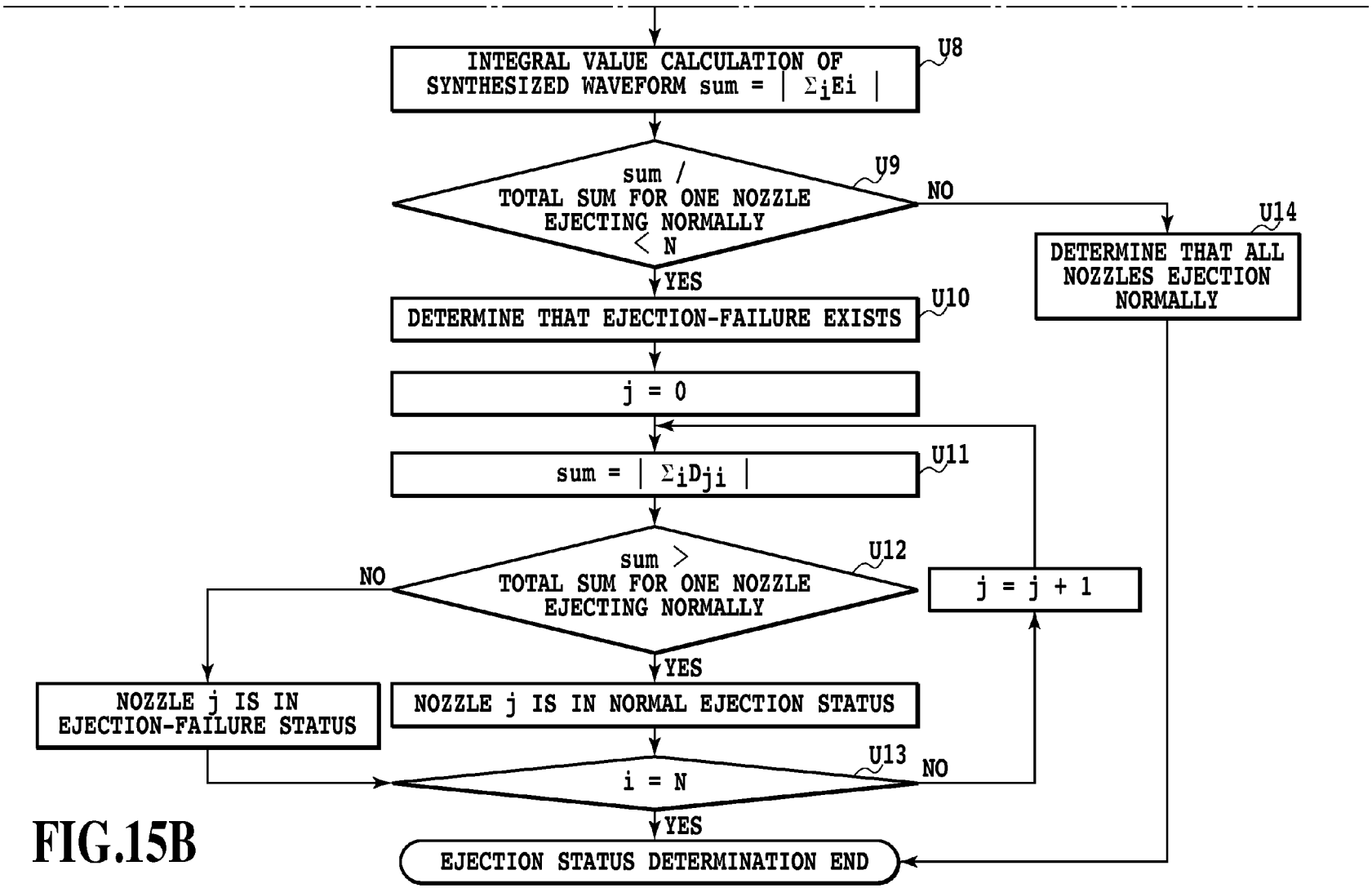
FIG. 15B is a flow chart illustrating the ejection status determining procedure in the third embodiment of the present invention.

FIG. 15 is a flow chart illustrating the specific ejection status determination processing procedure in the third embodiment of the present invention.

First, in step U1, the temperature waveform data in the predetermined section of N nozzles $T_{j0}$, $T_{j1}$ to $T_{jk}$; (j=1, 2 to N) are acquired at the same time.

Subsequently, in step U2, carried out in parallel is the processing which performs the second order differentiation on a plurality of the temperature waveform data acquired in step U1, and $D_{j0}$, $D_{j1}$ to $D_{jk-2}$ are acquired.

Subsequently, step U3 to step U6 are carried out in parallel for N number of second derivatives.

In step U3, the data $D_{ji}$ of the point in the second derivative is compared with the threshold value based on the second derivative at the time of the ejection-failure occurrence. When the former is smaller than the latter, the procedure will progress to step U4, and when the former is not less than the latter, the procedure will progress to step U5.

In step U4, the value $D_{ji}$ of the point in the second derivative is updated to the value where the threshold value based on the second derivative at the time of the ejection-failure occurrence is subtracted from the original value, and the procedure progresses to step U6. On the other hand, in step U5, the value $D_{ji}$, of the point in the second derivative is updated to zero, and the procedure progresses to step U6.

In step U6, it is determined based on the parameter i whether the updated data with updating completed is prepared with respect to the data of all the points in the second derivative. Then, if affirmative, the procedure will progress to step U7, while if negative, the parameter i is incremented by one and the process will return to step U3.

In step U7, the waveform where N number of waveforms are synthesized is prepared, and that is, the total data is calculated by summing up N number of the updated data. Subsequently, in step U8, the absolute value "sum" of the summation of the values (total data) of each point of the synthesized waveform is calculated.

Subsequently, in step U9, the value "sum" is divided by the summation for one nozzle ejecting normally, and the result is compared with the number of nozzles N. Then, in the case of a divided result is smaller than N, it is determined that an ejection-failure exists, and the procedure progresses to step U11, and the ejection status determination is carried out anew by selecting one nozzle at a time. On the other hand, in the case of the divided result is N or more it is determined that all N nozzles carry out ejection normally, and the present procedure is completed.

In step U11, calculated is the summation "sum" of each point of the waveform, of the selected nozzle, which is acquired in step U3 to step U5. Then, in step U12, the value "sum" is compared with the summation for one nozzle carrying out the ejection operation normally. When the former is larger than the latter, it is determined that the normal ejection has been carried out, and when the former is smaller than the latter, it is determined that the ejection-failure has occurred.

In step U13, it is determined whether the ejection status determination is completed or not with respect to all N nozzles. If affirmative, the present procedure will be completed, and on the other hand, while if negative, it will return to step U11.

4. Others

In the above description, the cases where the present invention is applied to the printing apparatus having a form of serial printer have been described. However, it is needless to say that the present invention is able to be applied also to the printing apparatus using a printing head with a so-called line form where nozzles are disposed over a range corresponding to overall width of the printing medium. In such printing apparatus, printing operation is performed with very high-speed, and a recovery process cannot be carried out with the printing head positioned in the recovery unit during a sequence of the printing operation. Therefore, the present invention is effective in view of specifying promptly the nozzle where ejection-failure has occurred during printing operation or during preliminary ejection to a cap, and carrying out promptly the recovery process or a complementary printing using other line form printing heads.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-322583, filed Dec. 18, 2008, which is hereby incorporated by reference herein in its entirety.

What is claimed is:

1. An ejection status determining method of determining an ink ejection status of an inkjet printing head including a heating element generating thermal energy as the energy utilized for ejecting ink and a temperature detecting element detecting a temperature change accompanying driving the heating element, the method comprising the steps of:

extracting, as extracted data, temperature information at a plurality of points in a predetermined section including a timing at which appears an inflection point arising from the ink being ejected normally by the driving of the heating element, in a descending process of the temperature detected by the temperature detecting element after the driving of the heating element;

computing a summation of absolute values of differences between each of curvatures of the temperature change curve at the plurality of points and a first threshold value determined based on a curvature of a temperature change curve in the case of an ejection-failure occurring; and determining an ejection status of the ink, based on the computed summation and a second threshold value with respect to the summation determined in advance.

2. An ejection status determining method of determining an ink ejection status of an inkjet printing head including a heating element generating thermal energy as the energy utilized for ejecting ink from a nozzle and a temperature detecting element detecting a temperature change accompanying driving the heating element, the method comprising the steps of:

extracting, as extracted data, temperature information at a plurality of points in a predetermined section including a timing at which appears an inflection point arising from the ink being ejected normally by the driving of the heating element, in a descending process of the temperature detected by the temperature detecting element after the driving of the heating element;

acquiring a second derivative by performing second order differentiation on the extracted data with respect to time;

computing a summation of absolute values of differences between each of values of the second derivative at the plurality of points and a first threshold value determined based on the second derivative in the case of an ejection-failure having occurred; and determining an ejection status of the ink, based on the computed summation and a second threshold value with respect to the summation determined in advance.

3. An ejection status determining method of determining an ink ejection status of an inkjet printing head including a heating element generating thermal energy as the energy utilized for ejecting ink from a nozzle and a temperature detecting element detecting a temperature change accompanying driving the heating element, the method comprising the steps of:

extracting, as extracted data, temperature information at a plurality of points in a predetermined section including a timing at which appears an inflection point arising from the ink being ejected normally by the driving of the heating element, in a descending process of the temperature detected by the temperature detecting element after the driving of the heating element;

acquiring a second derivative by performing second order differentiation on the extracted data with respect to time;

comparing each of values of the second derivative at the plurality of points with a first threshold value determined based on the second derivative in the case of an ejection-failure having occurred;

computing a summation of absolute values of differences between each of the values determined to be smaller than the first threshold value in the comparison step and the first threshold value; and determining an ejection status of the ink, based on the computed summation and a second threshold value with respect to the summation determined in advance.

4. An ejection status determining method of determining an ink ejection status of an inkjet printing head including a heating element generating thermal energy as the energy utilized for ejecting ink from a nozzle and a temperature detecting element detecting a temperature change accompanying driving the heating element, the method comprising the steps of:

extracting, as extracted data, temperature information at a plurality of points in a predetermined section including a timing at which appears an inflection point arising from the ink being ejected normally by the driving of the heating element, in a descending process of the temperature detected by the temperature detecting element after the driving of the heating element;

acquiring a second derivative by performing second order differentiation on the extracted data with respect to time;

comparing each of values of the second derivative at the plurality of points with a first threshold value determined based on the second derivative in the case of an ejection-failure having occurred;

preparing updated data where the value determined to be smaller than the first threshold value in the comparison step is updated by subtracting the first threshold value therefrom;

acquiring sum data obtained by summing the updated data with respect to a plurality of the nozzles;

computing a summation of the sum data with respect to the plurality of points; and determining, based on the computed summation and the summation of the updated data for one nozzle ejecting the ink normally, whether or not there exists a nozzle with the ejection-failure having occurred among the plurality of nozzles.

5. The ejection status determining method of the inkjet printing head according to claim 4, further comprising the steps of:

computing the summation of the updated data for each of the plurality of nozzles when the determination step determines that there exists a nozzle with the ejection-failure having occurred; and specifying the nozzle with the ejection-failure having occurred based on the computed summation and the summation of the updated data for the one nozzle ejecting the ink normally.

* * * * *